US007185561B1

(12) United States Patent
Eastman

(10) Patent No.: US 7,185,561 B1
(45) Date of Patent: Mar. 6, 2007

(54) CUTOUT FUSE TUBE MOUNTING TOOL

(76) Inventor: Rick H. Eastman, 2866 W. 14400 South, Bluffdale, UT (US) 84065

( * ) Notice: Subject to any disclaimer, the term of this patent is extended or adjusted under 35 U.S.C. 154(b) by 0 days.

(21) Appl. No.: 11/350,360

(22) Filed: Feb. 9, 2006

(51) Int. Cl.
*B25B 27/14* (2006.01)
*A47F 13/06* (2006.01)

(52) U.S. Cl. ..... 81/3.8; 81/53.1; 294/19.1

(58) Field of Classification Search ..... 81/3.8, 81/53.1; 294/116, 86.4, 19.1
See application file for complete search history.

(56) References Cited

U.S. PATENT DOCUMENTS 1,920,168 A * 8/1933 Bodendieck ..... 81/53.1
4,132,441 A 1/1979 Watkins
4,244,613 A 1/1981 Tillman
D292,168 S 10/1987 Seltzer et al.
5,742,220 A * 4/1998 Scherer ..... 81/53.1
6,474,197 B1 11/2002 Browen et al.
6,518,871 B2 2/2003 Fennell
6,725,745 B1 4/2004 Palmieri
2006/0150779 A1* 7/2006 Rider ..... 81/53.1

* cited by examiner

*Primary Examiner*—Hadi Shakeri

(57) ABSTRACT

A cutout fuse tube mounting tool includes a pole that has an upper end. A plate has a first lateral edge and a second lateral edge. Each of a pair of arms is attached to and extends away from one of the first and second lateral edges. Each of a pair of discs has an inner side and an outer side. The inner sides are each attached to an end of one of the arms. Each of the discs has a diameter smaller than an inner diameter of a loop attached to a cutout fuse tube. A coupler is configured to secure the plate to the upper end of the pole so that the top edge of the plate is directed away from the upper end. Each of the arms may be engaged with one of a pair of cutout fuse tubes by engaging an associated cutout fuse loop.

8 Claims, 4 Drawing Sheets

CUTOUT FUSE TUBE MOUNTING TOOL

BACKGROUND OF THE INVENTION

1. Field of the Invention

The present invention relates to safety fuse tools and more particularly pertains to a new safety fuse tool for installing cutout fuse tubes in a cutout fuse socket. The present invention may also be used for removing such cutout fuse tubes from the sockets. The present invention may be attached to telescoping extension poles or universal hot stick devices.

2. Description of the Prior Art

The use of safety fuse tools is known in the prior art. U.S. Pat. No. 6,725,745 describes a device for assisting a person in mounting a safety fuse. Another type of safety fuse tool is U.S. Pat. No. 4,244,613 configured for extracting and replacing high voltage fuses. Yet another device for engaging a fuse to be removed or mounted is found in U.S. Pat. No. 6,518,871. Still yet another such device is found in U.S. Pat. No. 6,474,197.

While these devices fulfill their respective, particular objectives and requirements, the need remains for a device for simultaneously holding a pair of cutout fuse tubes to allow for quicker replacement of the tubes. Further, the device should have a construction that prevent the accidental dropping of the cutout fuses while they are being installed or removed.

SUMMARY OF THE INVENTION

The present invention meets the needs presented above by generally comprising a pole that has an upper end. A plate has a first side, a second side, a top edge, a bottom edge, a first lateral edge and a second lateral edge. Each of a pair of arms has a first end attached to one of the first and second lateral edges. The arms extend in opposite directions with respect to each other and lie in a plane of the plate. Each of a pair of discs has an inner side and an outer side. The inner sides are each attached to a second end of one of the arms. Each of the discs has a diameter smaller than an inner diameter of a loop attached to a cutout fuse tube. A coupler is configured to secure the plate to the upper end of the pole so that the top edge of the plate is directed away from the upper end. Each of the arms may be extending through one of a pair of loops attached to cutout fuse tubes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
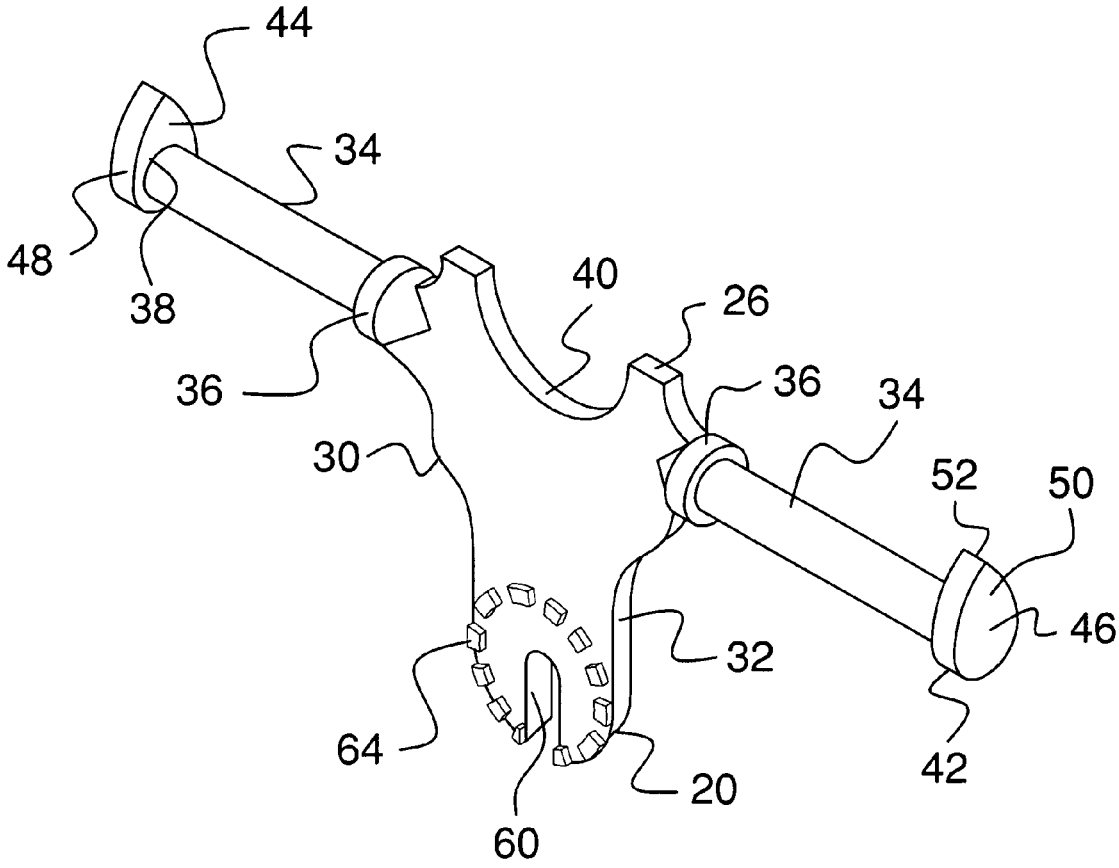
FIG. 1 is a perspective view of a cutout fuse tube mounting tool according to the present invention.
Figure 2:
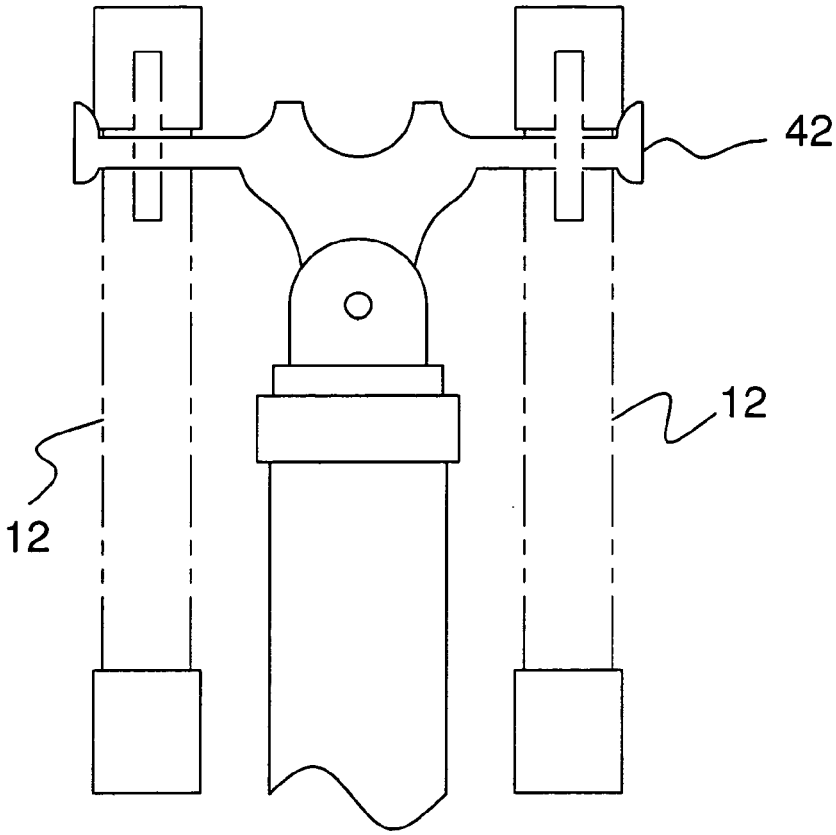
FIG. 2 is a front in-use view of the present invention.
Figure 3:
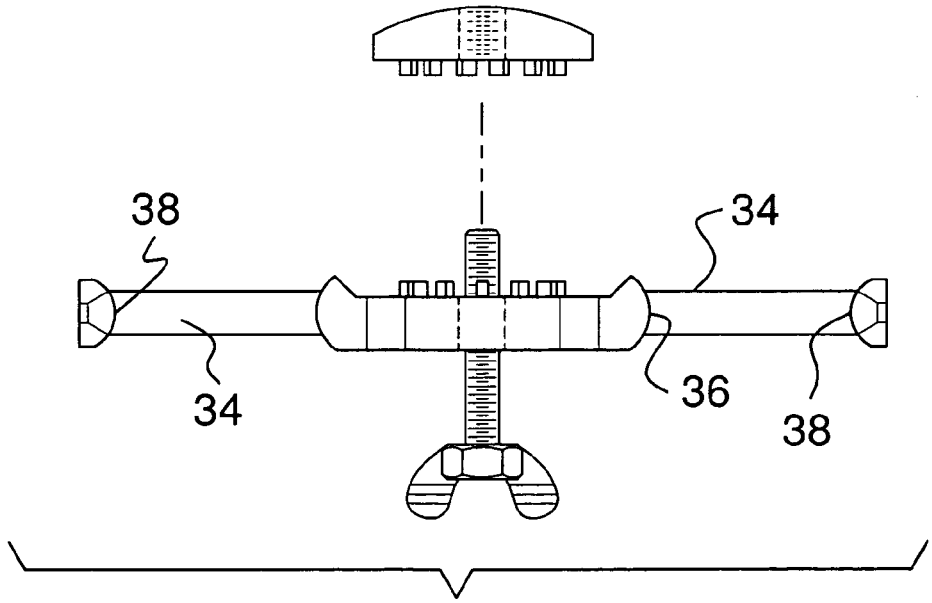
FIG. 3 is a top view of the present invention.
Figure 6:
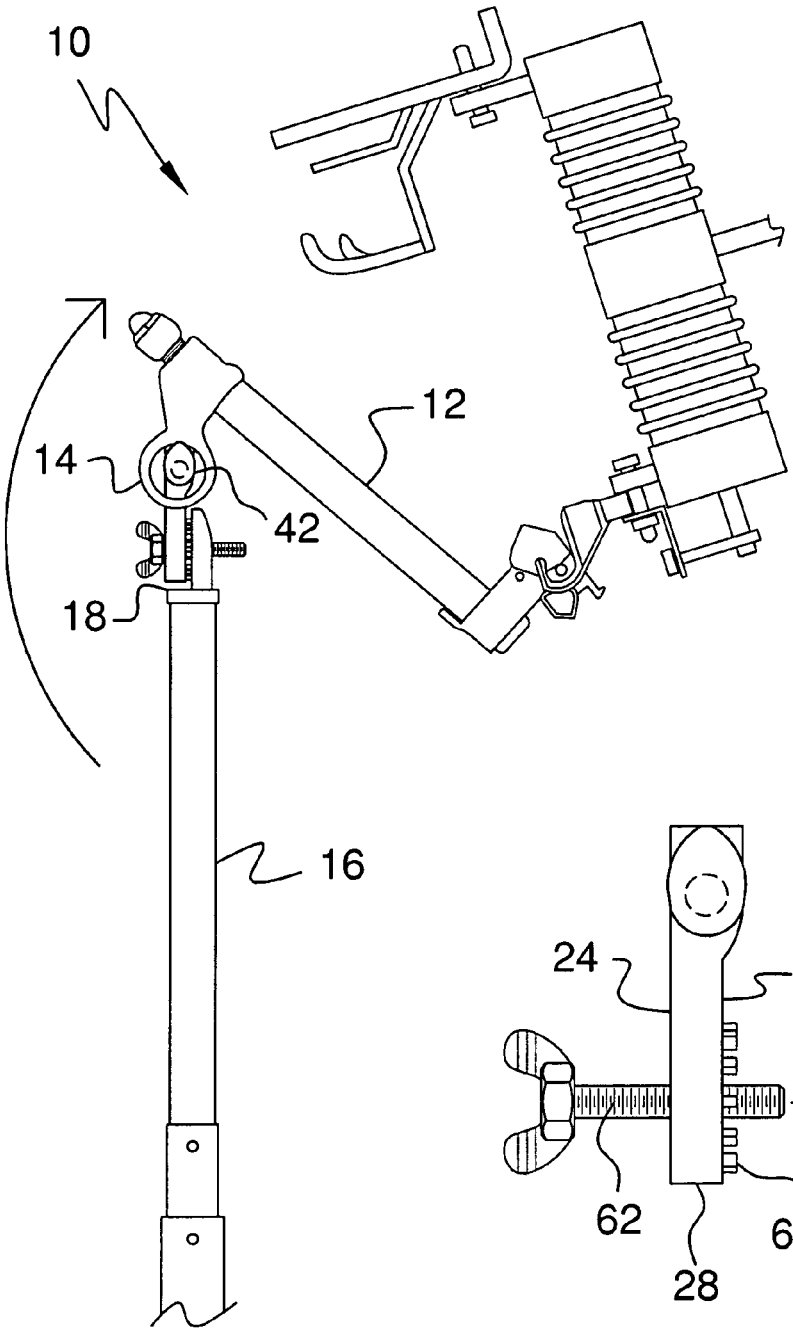
FIG. 6 is a side in-use view of the present invention.
Figure 4:
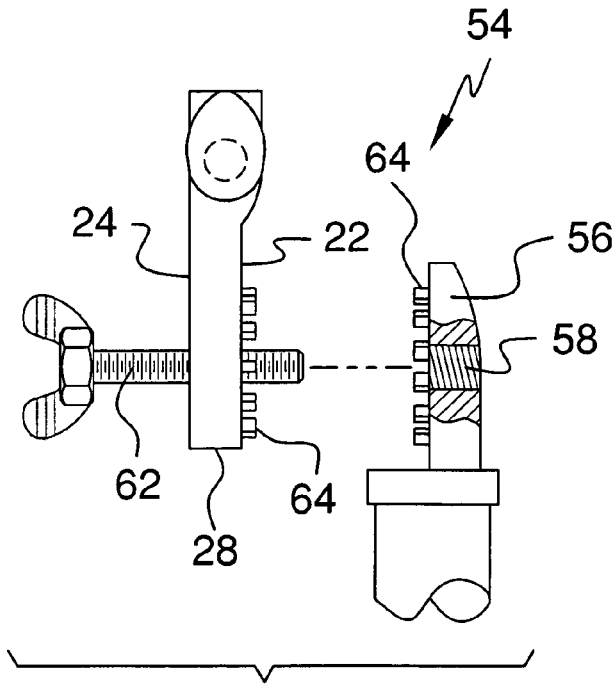
FIG. 4 is a side view of the present invention.

With reference now to the drawings, and in particular to FIGS. 1 through 6 thereof, a new safety fuse tool embodying the principles and concepts of the present invention and generally designated by the reference numeral 10 will be described.

As best illustrated in FIGS. 1 through 6, the cutout fuse tube mounting tool 10 generally comprises a device for aiding an overhead lineman in mounting a cutout fuse tube 12. These tubes 12 have a first loop 14 and a second loop 15 attached to them that may be engaged with the tool 10.

The tool 10 comprises an extension pole 16 that has an upper end 18. The extension pole 16 may be any conventional telescopic pole used for working on power lines. The pole preferably has a maximum extendable length up to 40 feet and may be as short as an 8 foot universal hot stick.

A plate 20 has a first side 22, a second side 24, a top edge 26, a bottom edge 28, a first lateral edge 30 and a second lateral edge 32. A pair of arms 34 is provided. Each of the arms 34 has a first end 36 and a second end 38. Each of the first ends 36 is attached to one of the first 30 and second 32 lateral edges. The arms 36 extend in opposite directions with respect to each other and each lies in a plane of the plate 20. The first ends 36 are positioned adjacent to the top edge 26. The top edge 26 has an arcuate indentation 40 therein.

A pair of discs 42 is provided. Each of the discs 42 has an inner side 44 and an outer side 46. Each of the inner sides 44 is attached to one of the second ends 38 of the arms 34 and each of the discs 42 has a diameter smaller than an inner diameter of the loops 14 and 15 so that the discs 42 may be readily extended through the loops 14, 15. Each of the discs 42 has a peripheral edge 48 and each of the peripheral edges 48 includes a pointed catch 50 extending upwardly from discs 42. The catches 50 each have a free end 52 that is generally aligned with the top edge 26 of the plate 20. The catches 50 assist a person in retaining the loops 14 on the arms 34. The inner sides 44 may be convex for allowing a person to slide the loops 14, 15 off an associated one of the arms 34 in a controlled fashion.

A coupler 54 is configured to secure the plate 20 to the upper end 18 of the pole 16 so that the top edge 26 of the plate 20 is directed away from the upper end 18. The coupler 54 includes a tab 56 that is attached to and extends upwardly from the top end 18. The tab 56 has an aperture 58 extending therethrough. The bottom edge 28 of the plate 20 has a slot 60 extending therein. A fastener 62 is extended through the slot 60 and threadably coupled to the aperture 58 so that the tab 56 is secured to the plate 20. A plurality of teeth 64 is mounted on the plate 20 and on the tab 56. The teeth 64 on the plate 20 engage the teeth 64 on the tab 56 when the tab 56 is secured to the plate 20. The teeth 64 also allow the plate 20 to be secured to the pole 16 at a selected angle.

Figure 5:
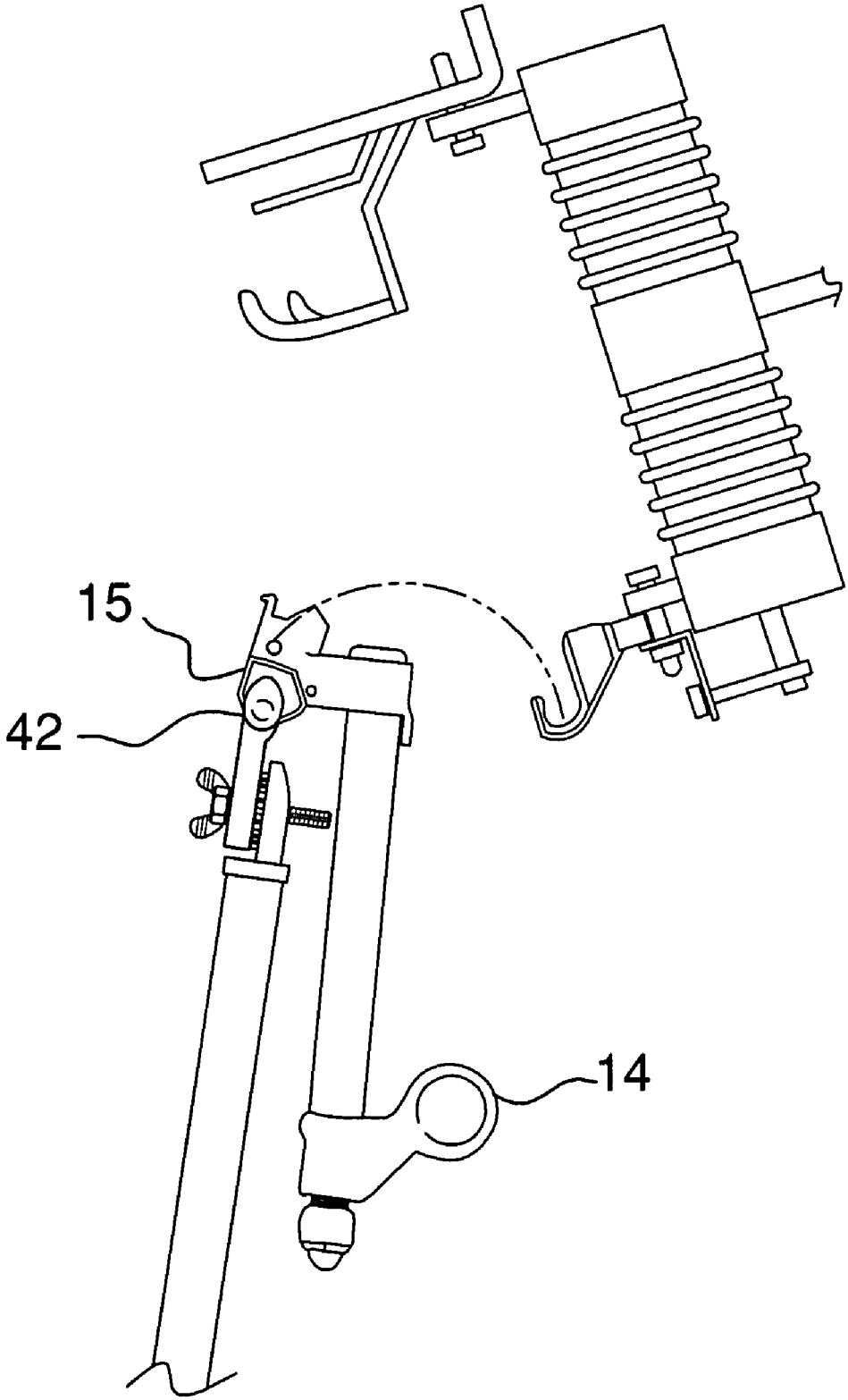
FIG. 5 is a side in-use view of the present invention.

In use, one of the arms 34 may be extended through one of the loops 14, or two loops 14 may be engaged by using each of the arms 34. When two loops are engaged 14, one by each of the arms 34, the user may then remove two fuse tubes 12 at the same time. Alternatively, the loop 14 may be engaged to lift the fuse tube into a closed position (FIG. 6) after loop 15 has been used by an arm 34 to place the fuse tube 12 in its cradle, as shown in FIG. 5. Again, this installation of fuse tubes 12 may also be done two at time to save time. The arcuate indentation 40 may be used for abutting against and urging the fuse tubes 12 into their sockets. The teeth 64 allow the plate 20 to be secured to the tab 56 at an angle if needed. Further, the tool 10 may be used for closing fused cutouts, solid blade cutouts or opening and closing bridge switches.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cutout fuse tube mounting assembly for removably engaging a pair of cutout fuse tubes, each of the fuse tubes having a pair of loops attached thereto, said assembly comprising:

a pole having an upper end;

a plate having a first side, a second side, a top edge, a bottom edge, a first lateral edge and a second lateral edge, a pair of arms each having a first end a second end, each of said first ends being attached to one of said first and second lateral edges, said arms extending in opposite directions with respect to each other from the respective lateral edge and lying in a plane of said plate;

a pair of discs, each of said discs having an inner side and an outer side, each of said inner sides being attached to one of said second ends of said arms, each of said discs having a diameter smaller than an inner diameter of the loop;

a coupler being configured to secure said plate to said upper end of said pole such that said top edge of said plate is directed away from said upper end; and wherein each of said arms may be engaged with one of the cutout fuse tubes by engaging an associated one of the loops.

2. The assembly according to claim 1, wherein each of said first ends of said arms are positioned adjacent to said top edge.

3. The assembly according to claim 1, wherein said top edge has an arcuate indentation therein.

4. The assembly according to claim 1, wherein each of said discs having a peripheral edge, each of said peripheral edges including a pointed catch extending upwardly from discs.

5. The assembly according to claim 4, wherein said catches each have a free end being generally aligned with said top edge of said plate.

6. The assembly according to claim 1, wherein said coupler includes a tab being attached to and extending upwardly from said upper end, said tab having an aperture extending therethrough, said bottom edge of said plate having a slot extending therein, a fastener being extended through said slot and threadably coupled to said aperture such that said tab is secured to said plate.

7. The assembly according to claim 6, further including a plurality of teeth being mounted on said plate and on said tab, said teeth on said plate engaging said teeth on said tab when said tab is secured to said plate.

8. A cutout fuse tube mounting assembly for removably engaging a pair of cutout fuse tubes, each of the fuse tubes having a pair of loops attached thereto, said assembly comprising:

an extension pole having an upper end;

a plate having a first side, a second side, a top edge, a bottom edge, a first lateral edge and a second lateral edge, a pair of arms each having a first end a second end, each of said first ends being attached to one of said first and second lateral edges, said arms extending in opposite directions with respect to each other from the respective lateral edge and lying in a plane of said plate, said first ends being positioned adjacent to said top edge, said top edge having an arcuate indentation therein;

a pair of discs, each of said discs having an inner side and an outer side, each of said inner sides being attached to one of said second ends of said arms, each of said discs having a diameter smaller than an inner diameter of the loop, each of said discs having a peripheral edge, each of said peripheral edges including a pointed catch extending upwardly from discs, said catches each having a free end being generally aligned with said top edge of said plate;

a coupler being configured to secure said plate to said upper end of said pole such that said top edge of said plate is directed away from said upper end, said coupler including a tab being attached to and extending upwardly from said upper end, said tab having an aperture extending therethrough, said bottom edge of said plate having a slot extending therein, a fastener being extended through said slot and threadably coupled to said aperture such that said tab is secured to said plate, a plurality of teeth being mounted on said plate and on said tab, said teeth on said plate engaging said teeth on said tab when said tab is secured to said plate; and wherein each of said arms may be engaged with one of the cutout fuse tubes by engaging an associated one of the loops.

* * * * *